US007536144B2

(12) United States Patent
Ohta

(10) Patent No.: US 7,536,144 B2
(45) Date of Patent: May 19, 2009

(54) ENDLESS BELT AND IMAGE FORMING APPARATUS

(75) Inventor: Shigeo Ohta, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 446 days.

(21) Appl. No.: 11/543,817

(22) Filed: Oct. 6, 2006

(65) Prior Publication Data

US 2007/0206979 A1 Sep. 6, 2007

(30) Foreign Application Priority Data

Mar. 2, 2006 (JP) ..... 2006-056510

(51) Int. Cl.
*G03G 15/01* (2006.01)

(52) U.S. Cl. ..... 399/302; 399/303; 198/840

(58) Field of Classification Search ..... 399/162, 399/165, 299, 302, 303, 308, 312, 313, 329; 198/837, 840, 844.1; 474/122, 151, 167, 474/174

See application file for complete search history.

(56) References Cited

U.S. PATENT DOCUMENTS 5,017,969 A * 5/1991 Mitomi et al. ..... 399/299
5,784,675 A * 7/1998 Inoue et al. ..... 399/297
5,873,016 A * 2/1999 Kurokawa et al. ..... 399/297
6,141,522 A * 10/2000 Tsuruoka et al. ..... 399/302
6,160,978 A * 12/2000 Tsuruoka et al. ..... 399/165
6,674,989 B1 * 1/2004 Kusaba et al. ..... 399/302
6,733,407 B2 * 5/2004 Wakana ..... 474/92
7,242,897 B2 * 7/2007 Satoh et al. ..... 399/329
2005/0095041 A1 * 5/2005 Kim et al. ..... 399/302
2006/0172097 A1 * 8/2006 Morikoshi et al. ..... 428/35.7

FOREIGN PATENT DOCUMENTS

JP A 2000-122439 4/2000
JP 2003107931 A * 4/2003
JP A 2005-31301 2/2005
JP 2005202091 A * 7/2005

* cited by examiner

*Primary Examiner*—Robert Beatty
(74) *Attorney, Agent, or Firm*—Oliff & Berridge, PLC

(57) ABSTRACT

An endless belt including a belt main body in which a ten-point average roughness (Rz) of an inner peripheral surface thereof is in a range of 2.0 μm or higher and 10.0 μm or lower and an average distance (Sm) between projections and depressions of the inner peripheral surface is in a range of 50 μm or higher and 200 μm or lower, and a guide portion in which an average distance (Sm') between projections and depressions on an adhesive surface thereof adhered to the inner peripheral surface of the belt main body along an edge of the belt main body is two times or higher and six times or lower the average distance (Sm) between projections and depressions in the inner peripheral surface.

14 Claims, 5 Drawing Sheets

| | Rz(μm) of inner peripheral surface of belt main body | Average distance Sm (μm) bet. projections and depressions of inner peripheral surface of belt main body | Ratio Sm' / Sm of average distance bet.projections and depressions, adhesive surface of guide portion to inner peripheral surface of belt main body | Peel strength | Output of 500 sheets continuously | | |
|---|---|---|---|---|---|---|---|
| | | | | | Image quality in the course of continuous output | Peeling of guide portion | Image quality when continuous output is completed |
| Example 1 | 2.2 | 51 | 5.8 | Excellent | Excellent | No peeling generated | Excellent |
| Example 2 | 9.8 | 197 | 2.1 | Excellent | Excellent | No peeling generated | Excellent |
| Example 3 | 2.1 | 52 | 2.1 | Excellent | Excellent | Peeling is slightly generated | Fair |
| Example 4 | 9.9 | 196 | 5.9 | Excellent | Fair | No peeling generated | Fair |
| Comparative example 1 | 1.8 | 53 | 2.1 | Failed | Excellent | Peeling is generated (image forming operation is stopped) | |
| Comparative example 2 | 11.0 | 198 | 2.0 | Fair | Excellent | Peeling is generated (image forming operation is stopped) | |
| Comparative example 3 | 2.5 | 45 | 2.2 | Failed | Excellent | Peeling is generated (image forming operation is stopped) | |
| Comparative example 4 | 8.0 | 220 | 5.6 | Fair | Fair | Peeling is slightly generated | Failed |
| Comparative example 5 | 3.0 | 81 | 1.5 | Fair | Excellent | Peeling is generated (image forming operation is stopped) | |
| Comparative example 6 | 9.0 | 197 | 6.6 | Excellent | Failed | No peeling generated | Failed |

Peel strength

Excellent: 5.0N/mm or higher both at 45°C and 5°C

Fair: less than 5.0 N/mm either at 45°C or 5°C

Failed: less than 5.0 N/mm both at 45°C and 5°C

Fig. 6

ENDLESS BELT AND IMAGE FORMING APPARATUS

BACKGROUND (i) Technical Field

The present invention relates to an endless belt having an annular belt main body, and to an image forming apparatus that forms an image consisting of a fixed toner image on a recording medium.

(ii) Related Art

Conventionally, image forming apparatuses such as printers and copiers have become pervasive, and techniques concerning various elements constituting such image forming apparatuses also have become pervasive. Of the image forming apparatuses, an image forming apparatus employing an electrophotography system forms a static latent image by exposing a surface of a charged photosensitive body to light, develops the static latent image to form a toner image, and finally transfers the toner image on a recording medium at a predetermined transfer position, thereby forming an image. One such image forming apparatus employs, in the process of the image formation, an endless belt that is stretched around support rolls and that circulates and moves as a unit that carries the formed toner image to a transfer position, or as a unit that transfers the recording medium to the transfer position. In an image forming apparatus that forms a color image, since it is necessary to superpose toner images of many colors on one another, the endless belt is used in many cases as a carrying unit that carries a toner image while sequentially receiving transfer of toner images each having different color, or as a transfer unit of a recording medium that sequentially receiving transfer of toner images each having different color.

In a field of the image forming apparatuses of recent years, it is increasingly required to provide an image forming apparatus that has high output speed as well as high endurance capable of withstanding, for example, temperature variation and high volume output.

SUMMARY

According to one aspect of the present invention, there is provided an endless belt including:

a belt main body in which a ten-point average roughness (Rz) of an inner peripheral surface thereof is in a range of approximately 2.0 μm or higher and 10.0 μm or lower and an average distance (Sm) between projections and depressions of the inner peripheral surface is in a range of approximately 50 μm or higher and 200 μm or lower; and a guide portion in which an average distance (Sm') between projections and depressions on an adhesive surface thereof adhered to the inner peripheral surface of the belt main body along an edge of the belt main body is approximately two times or higher and six times or lower the average distance (Sm) between projections and depressions in the inner peripheral surface.

BRIEF DESCRIPTION OF THE DRAWINGS

Preferred embodiment of the present invention will be described in detail based on the following figures, wherein:

FIG. 6 shows a result of a peel strength of an intermediate transfer belt of each of first to fourth examples and first to sixth comparative examples, and an output test.

DETAILED DESCRIPTION

Figure 1:
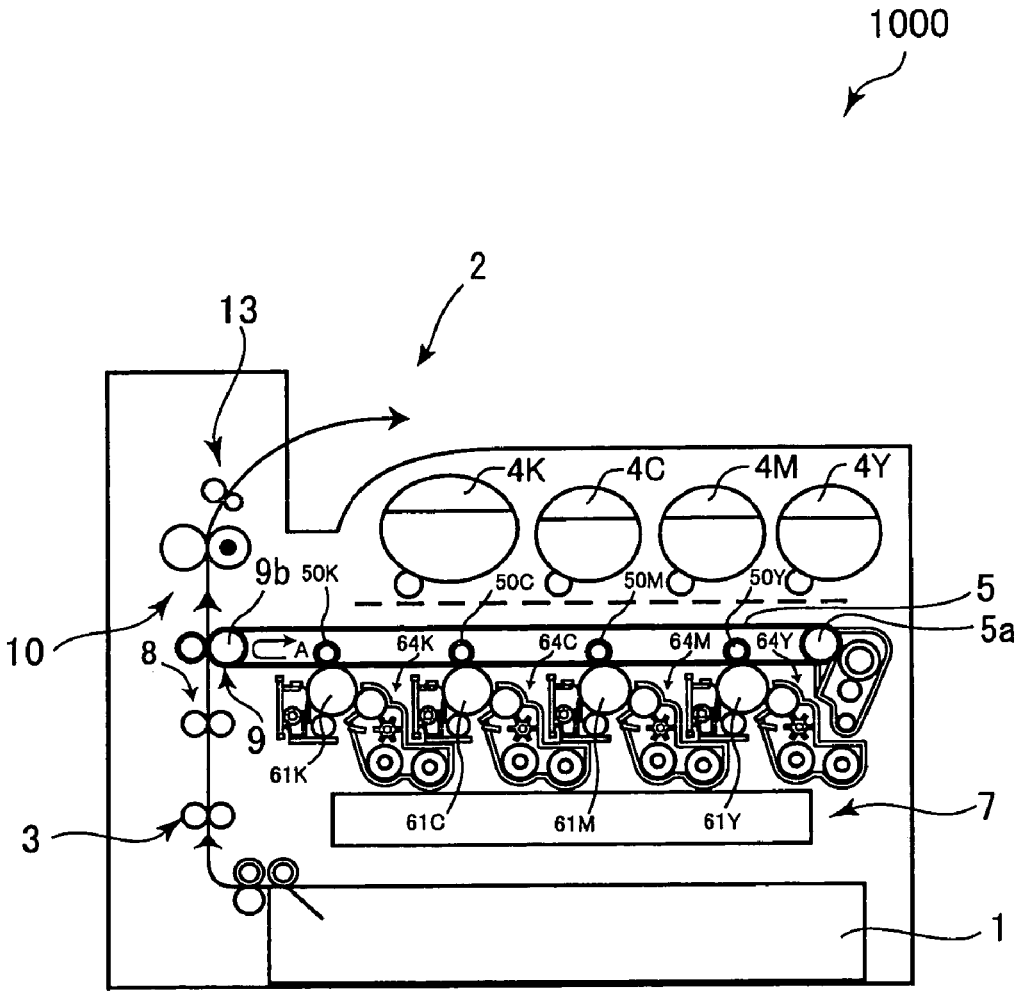
FIG. 1 shows an entire structure of an image forming apparatus of an embodiment.

FIG. 1 is a diagram of the entire structure of the image forming apparatus of the embodiment.

The image forming apparatus of the embodiment is a single-sided output color printer.

The image forming apparatus 1000 includes image holders 61Y, 61M, 61C and 61K that carry static latent images of black (K), cyan (C), magenta (M) and yellow (Y), developing devices 64K, 64C, 64M and 64Y that develop the static latent images carried by the image holders with toner of each color to form a toner image of each color, an intermediate transfer belt 5 that receives transfer of the formed toner image of each color and carries the toner image, primary transfer rolls 50K, 50C, 50M and 50Y that perform primary transfer of the toner image of each color to the intermediate transfer belt 5, a pair of secondary transfer rolls 9 that perform secondary transfer to paper sheets, an exposing section 7 that emits laser light, a fixing device 10 that fuses the toner image, four toner cartridges 4K, 4C, 4M and 4Y that supplies toner of respective color components to the four toner image forming sections, and a tray 1 in that the paper sheets are accommodated. The intermediate transfer belt 5 is stretched by a secondary transfer roll 9*b* and a drive roll 5*a* while receiving a driving force from the drive roll 5*a*, and in this state, the intermediate transfer belt 5 circulates and moves in a direction shown with an arrow A in the drawing. This intermediate transfer belt 5 corresponds to one example of the endless belt according to the embodiment.

Next, the image forming operation of the image forming apparatus 1000 will be explained.

Static latent images are formed on the four image holders 61Y, 61M, 61C and 61K upon reception of laser light emitted from the exposing section 7. The formed static latent images are developed in respective colors by the developing devices 64K, 64C, 64M and 64Y, and toner images are formed. The toner images of respective colors formed in this manner are sequentially transferred onto the intermediate transfer belt 5 in the order of yellow (Y), magenta (M), cyan (C) and black (K) and superposed on one another, and a multicolored toner image is formed. The multicolored toner image is carried to the pair of secondary transfer rolls 9 by the intermediate transfer belt 5. In reply to the formation of such a multicolored toner image, the paper sheet is taken out from the tray 1 and is sent by transfer rolls 3, and the paper sheet is aligned in position by the pair of rolls 8. The multicolored toner image is transferred to the sent paper sheet by the pair of secondary transfer rolls 9, and the multicolored toner image is fused onto the paper sheet by the fixing device 10. After the fixing operation, the paper sheet having the multicolored toner image passes through a pair of sending-out rolls 13 and is output into an exit tray 2.

The image forming operation in the image forming apparatus 1000 has been explained above. In the image forming operation, the intermediate transfer belt 5 receives the transfer of the toner image of each color, and sends the toner image to a transfer position on the paper sheet, and plays a key role in the image forming operation.

Generally, in an image forming apparatus that employs a method for forming a color image through such an intermediate transfer belt, if the secondary transfer roll 9*b* that stretches the intermediate transfer belt 5 and the rotation shaft of the drive roll 5*a* are not in parallel to each other even slightly due to an error at the time of assembling, or if a tension applied to the intermediate transfer belt 5 is varied between locations on the intermediate transfer belt, the intermediate transfer belt may not run straightly while oscillating in the axial direction of the support roll (so-called meandering). If an image is formed in a state where the intermediate transfer belt runs in the deviated manner due to the meandering, an image failure is caused, i.e., a toner image is transferred to a position deviated from a proper position when the toner image is transferred onto the paper sheet. This results in an image failure such as a color deviation and a color tint variation in a color image to be formed.

According to the image forming apparatus 1000, the intermediate transfer belt 5, and the secondary transfer roll 9*b*, the drive roll 5*a* and the primary transfer rolls 50K, 50C, 50M and 50Y with which an inner surface of the intermediate transfer belt 5 comes into contact are configured to prevent the running deviation of the intermediate transfer belt 5. The details will be explained below.

Figure 2:
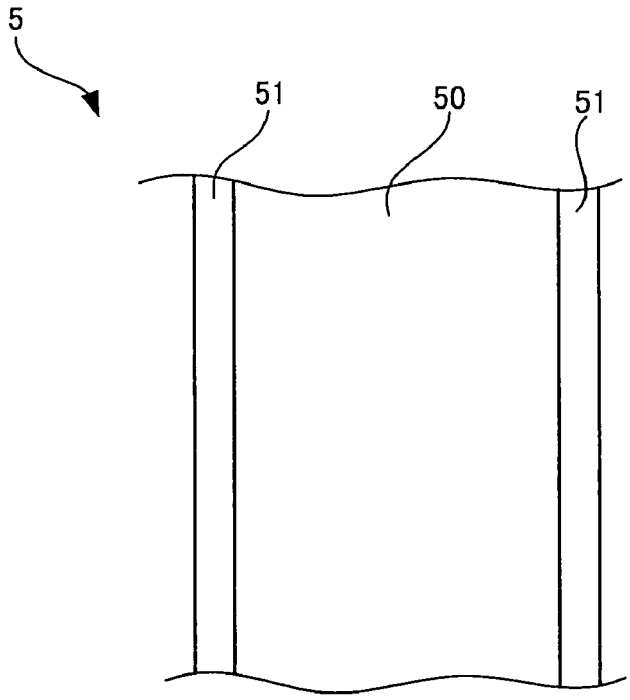
FIG. 2 shows a structure of an inner peripheral surface of an intermediate transfer belt shown in FIG. 1.
Figure 3:
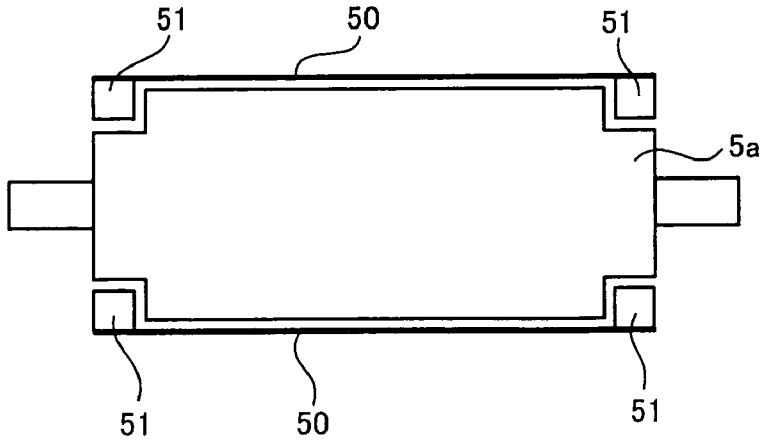
FIG. 3 shows a sectional view of a stretch roll shown in FIG. 1 and the intermediate transfer belt in contact with the stretch roll.

FIG. 2 shows a structure of an inner peripheral surface of the intermediate transfer belt 5 shown in FIG. 1. FIG. 3 shows a sectional view of a stretch roll 5*a* shown in FIG. 1 and the intermediate transfer belt 5 in contact with the stretch roll 5*a*.

FIG. 2 shows a portion of the inner peripheral surface of the intermediate transfer belt 5, i.e., a portion of a surface of the intermediate transfer belt 5 that is in contact with the secondary transfer roll 9*b*, the drive roll 5*a*, and the primary transfer rolls 50K, 50C, 50M and 50Y. FIG. 2 shows guide portions 51 provided along both edges of a main body 50 of the intermediate transfer belt 5 (hereafter referred to as "the belt main body 50"). As shown in FIG. 3, recesses are formed in the drive roll 5*a*, at its both edge portions, and the intermediate transfer belt 5 runs in a state where the guide portions 51 abut against the walls of the recesses. The similar recesses are formed in the secondary transfer roll 9*b* and the primary transfer rolls 50K, 50C, 50M and 50Y shown in FIG. 1. The intermediate transfer belt 5 runs in a state where the guide portions 51 abut against walls of the recesses formed in these rolls.

The guide portions 51 are caught on the recessed walls formed in the secondary transfer roll 9*b*, the drive roll 5*a* and the primary transfer rolls 50K, 50C, 50M and 50Y, and thus the moving direction of the intermediate transfer belt 5 is limited to the straight moving direction, and the running deviation is prevented.

Structures of the belt main body 50 and the guide portions 51 will be explained. The belt main body 50 made of polyimide-based resin as main ingredient is mixed with carbon black that is a kind of conductive material, so as to make the belt main body 50 a semi-conductive material. Polyimiode is a material that can easily be machined and that has high endurance. By employing the polyimide as main ingredient of the belt main body 50, the belt main body 50 is made less prone to be deteriorated and degraded. The structure of the guide portion 51 is formed by adhering, as shown in FIG. 2, a thin and long polyurethane elastomer having a predetermined thickness and width onto the belt main body 50 one each along both edges of the belt main body 50 using elastically deformable adhesive.

When high speed output or high volume output is performed, a large load is applied to the guide portion 51 and the guide portion 51 is likely to be peeled off from the belt main body 50. If the guide portion 51 is peeled off from the belt main body 50, this causes meandering of the endless belt, and the image failure is generated. Thus, in the intermediate transfer belt 5, a surface property of the inner peripheral surface of the belt main body 50 (surface roughness, distribution of projections and depressions described by referring to distances between the projections and depressions) and a property of the surface of the guide portion 51 to which adhesive is applied (hereafter referred to as "adhesive surface") are so devised that the adhesive strength between the guide portion 51 and the belt main body 50 can be enhanced.

In the case of a surface property in which an appropriate amount of projections and depressions are distributed on a surface, the adhesive enters between the projections and depressions at the time of adhering operation and the adhesive strength is enhanced by a so-called anchor effect. Thus, it is desirable to have certain amount of projections and depressions distributed on the inner peripheral surface of the belt main body 50. More specifically, as a surface property in the inner peripheral surface of the belt main body 50, if a ten-point average roughness (Rz) pursuant to JIS B 0601('94) is in a range of 2.0 μm to 10.0 μm, and the average distance (Sm) between projections and depressions pursuant to JIS B 0601 ('94) is in a range of 50 μm to 200 μm, high adhering strength is realized when the guide portion 51 is adhered to the inner peripheral surface of the belt main body 50. When the ten-point average roughness (Rz) is less than 2.0 μm, or if the average distance (Sm) exceeds 200 μm, the anchor effect is too low to get sufficient adhering strength. When the ten-point average roughness (Rz) exceeds 10.0 μm or when the average distance (Sm) between the projections and depressions is less than 50 μm, the thickness of the layer made of adhesive (hereafter referred to as "adhesive layer") that is superposed on the inner peripheral surface of the belt main body 50, becomes thin at the portions superposed on the projections, and thus, the distribution of the adhering strength becomes uneven, and the adhesive state is weak against impact from outside.

Here, the ten-point average roughness (Rz) and the average distance (Sm) between projections and depressions can be measured using SURFCOM 1400A (trade name) produced by TOKYO SEIMITSU CO., LTD under the condition of evaluation length Ln=4 mm, reference length L=0.8 mm and cut off value=0.8 mm.

If the average distance (Sm') between the projections and depressions of the adhesive surface of the guide portion 51 is, according to the JIS B 0601('94), in a range of two times to six times the average distance (Sm) between the projections and depressions of the inner peripheral surface of the belt main body 50, high adhering strength is realized when the guide portion 51 is adhered to the inner peripheral surface of the belt main body 50, and an excellent image can be formed. If the average distance (Sm') between the projections and depressions in the adhesive surface of the guide portion 51 is less than two times the average distance (Sm) between the projections and depressions of the inner peripheral surface of the belt main body 50, the projections of both the surfaces are prone to correspond to each other, making the adhesive layer near the projections thin and the distribution of the adhering strength uneven. Thus, the adhering state becomes weak against the impact from outside. If the average distance (Sm') between the projections and depressions of the adhesive surface of the guide portion 51 exceeds six times the average distance (Sm) between the projections and depressions of the inner peripheral surface of the belt main body 50, since the average distance (Sm') between the projections and depressions of the adhesive surface of the guide portion 51 is long, a wave having long wavelength appears on the surface of the guide portion 51, and image is disturbed when an image is formed at high speed.

In summary, the inner peripheral surface of the belt main body 50 has such a surface property that the ten-point average roughness (Rz) is in the range of 2.0 μm to 10.0 μm, the average distance (Sm) between the projections and depressions is in the range of 50 μm to 200 μm, and the average distance (Sm') between the projections and depressions of the adhesive surface of the guide portions is in the range of two times to six times the average distance (Sm) between the projections and depressions of the inner peripheral surface of the belt main body 50. In this state, high adhering strength is realized and an excellent image can be formed. The belt main body 50 and the guide portions 51 satisfy this condition.

In the intermediate transfer belt 5 explained above, the main ingredient of the belt main body 50 is polyimide-based resin, but it is also possible to employ polyamideimide-based resin instead of polyimide-based resin. The intermediate transfer belt 5 having the belt main body made of polyamideimide-based resin as main ingredient, and the image forming apparatus using this intermediate transfer belt are different from the image forming apparatus 1000 employing the polyimide-based resin only in the material of the belt main body 50 and thus, redundant explanation will be omitted here. This polyamideimide is also a material that can easily be machined and that has high endurance like the polyimide. If the polyamideimide is employed as the main ingredient of the belt main body 50, an intermediate transfer belt that is less prone to be deteriorated and degraded is also realized.

In the belt main body, it is also possible to employ polyester-based resin instead of polyimide-based resin or polyamideimide-based resin. The intermediate transfer belt having the belt main body made of polyester-based resin as main ingredient, and the image forming apparatus using this intermediate transfer belt are different from the intermediate transfer belt 5 employing polyimide-based resin and the image forming apparatus 1000 using this intermediate transfer belt 5 only in the material of the belt main body and thus, redundant explanation will be omitted here. The polyester-based resin has a merit that it is less expensive and easy to obtain as compared with polyimide-based resin and polyamideimide-based resin, enabling cost reduction.

Although the endless belt according to the embodiment is applied to the intermediate transfer belt 5 in the above explanation, it is also possible to apply the endless belt to a belt used for transferring paper sheets. Such a transfer sending belt and an image forming apparatus having the transfer sending belt will be explained below.

Figure 4:
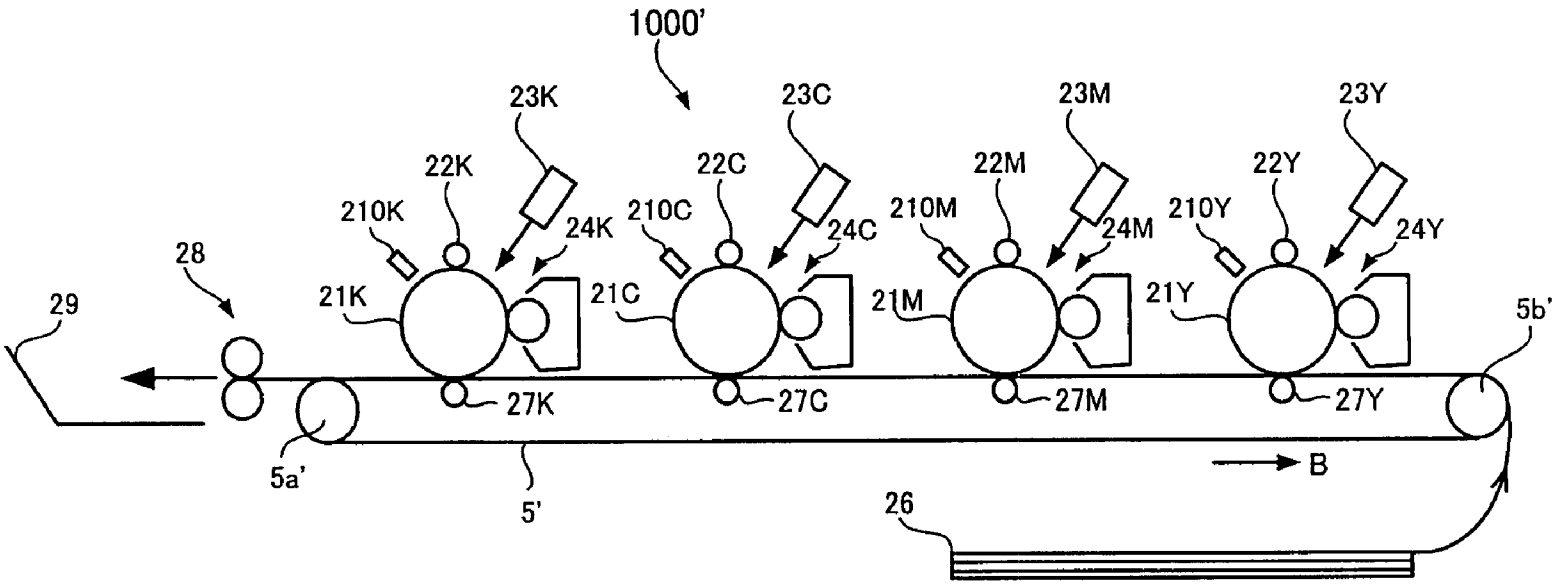
FIG. 4 is a schematic diagram showing a structure of an image forming apparatus having a transfer sending belt, according to another embodiment.

FIG. 4 is a schematic diagram showing a structure of an image forming apparatus having a transfer sending belt, according to another embodiment.

The image forming apparatus shown in this drawing is a single-sided output color printer. This image forming apparatus 1000' includes image holders 21Y, 21M, 21C and 21K formed with toner images of each color material, charging devices 22Y, 22M, 22C and 22K that charge surfaces of the image holders with predetermined potential uniformly, exposing sections 23Y, 23M, 23C and 23K that expose each of the image holders to light to form static latent images, developing devices 24Y, 24M, 24C and 24K that develops static latent image by each color toner to form a toner image of each color, a transfer sending belt 5' that circulates and moves along arrangement of each image holder, carries paper sheet sent from a paper sheet tray 26 and sends the same to transfer rolls 27Y, 27M, 27C and 27K provided for the image holders, cleaning blades 210Y, 210M, 210C and 210K that removes toner of each color remaining after transfer, and a fixing device 28 that fuses toner image onto the paper sheet. The transfer sending belt 5' circulates and moves in a direction shown with an arrow B in a state where the transfer sending belt 5' is stretched by the stretch roll 5*a*' and a drive roll 5*b*' while receiving a driving force from the drive roll 5*b*'. The transfer sending belt 5' corresponds to one example of the endless belt of the embodiment.

Next, an image forming operation in the image forming apparatus 1000' will be explained.

In the four image holders 21Y, 21M, 21C and 21K, static latent images are formed upon reception of laser light emitted from the exposing sections 23Y, 23M, 23C and 23K. The formed static latent images are developed with respective color toner by the developing devices 24Y, 24M, 24C and 24K and a toner image is formed. Upon the formation of the multicolored toner image, a paper sheet is taken out from the tray 26, it is sent to positions of the transfer rolls 27Y, 27M, 27C and 27K by the transfer sending belt 5', transfer of the toner image of each color is received at each transfer roll position, and a multicolored toner image is formed on the paper sheet. The multicolored toner image is fused by the fixing device 28 and is output into an exit tray 29.

In the above image forming operation, the transfer sending belt 5' has a key role, i.e., sends a paper sheet and receives transfer of toner image of each color in the paper sheet. If the running deviation of the transfer sending belt 5' is generated, the toner image is transferred to a position deviated from a proper position at the time of transfer of the toner image of each color on the paper sheet, and an image failure such as a color deviation and a color tint variation is generated in a color image to be formed. Thus, in the transfer sending belt 5' of the image forming apparatus 1000', the stretch roll 5*a*', the drive roll 5*b*' and the transfer rolls 27Y, 27M, 27C and 27K that come into contact with the inner surface of the transfer sending belt 5' are configured to prevent the transfer sending belt 5' from running in the deviated manner. This configuration is the same as that explained with reference to FIGS. 2 and 3. In the transfer sending belt 5' also, the surface property of the inner peripheral surface of the belt main body of the transfer sending belt 5' and the surface property of the adhesive surface of the guide portion are devised in the same manner as that of the above-described intermediate transfer belt 5. Thus, the image forming apparatus 1000' has high endurance with respect to the high speed output and high volume output, and an excellent image can be formed.

Concrete experiment data for demonstrating the effect of the endless belt of according to an aspect of the present invention will be explained. Here, as a concrete example, an intermediate transfer belt employing polyimide-based resin and an image forming apparatus employing this intermediate transfer belt are operated to perform the experiment.

First, a producing method of the intermediate transfer belt 5 used in this experiment will be explained.

First, 3,3',4,4'-biphenyl tetra carboxylic acid dianhydride and p-phenylenediamine are reacted in N-methyl-2-pyrrolidone, and polyimide precursor solution is prepared such that mass concentration is approximately 20%. Further, carbon black (SPECIAL BLACK 4 (produced by Degussa Co Ltd.) is dispersed in the solution as conducting agent, and conductive polyimide precursor solution having viscosity of 35 Pass at room temperature (25° C.) is prepared. This polyimide precursor solution is applied to a peripheral surface of an aluminum cylindrical body having an outer diameter of 364.5 mm and a length of 650 mm, and a polyimide precursor film having film thickness of about 420 μm is formed.

Next, an aluminum cylindrical body formed at its peripheral surface with polyimide precursor film is rotated at 6 rpm, and is heated and dried for 60 minutes at 170° C. Then, the aluminum cylindrical body is heated for 30 minutes at 360° C., the polyimide precursor film on the peripheral surface is inverted into imide, and a polyimide resin film is formed.

An annular polyimide resin film having a width of 369 mm is peeled off from the aluminum cylindrical body formed at its peripheral surface with the polyimide resin film. This polyimide resin film having the width of 369 is the belt main body. Urethane resins having a width of 5 mm, a height of 10 mm, and JIS-A hardness (JIS K6253: 97 type A durometer hardness defined in "hardness test method of vulcanized rubber and thermoplastic rubber") of A70/S are each pasted along both edges of the inner peripheral surface of the polyimide resin film having the width of 369 mm. This urethane resin is the guide portion.

The above describes the method of producing the intermediate transfer belt 5 used in this experiment.

In the above explanation, the surface property of the peripheral surface of the aluminum cylindrical body used for forming the polyimide resin film can be changed by polishing the peripheral surface of the aluminum cylindrical body while changing the polishing speed and the polishing pressure. The ten-point average roughness, and the average distance between projections and depressions in the belt main body can be controlled by adjusting the ten-point average roughness, and average distance between projections and depressions in the surface property of the aluminum cylindrical body. If aluminum cylindrical bodies having different surface properties are used, polyimide resin films having different surface properties of the inner peripheral surfaces can be produced. The average distance between the projections and depressions can be adjusted by directly polishing the surface property of the urethane resin corresponding to the guide portion. The image forming apparatus used in this experiment is an image forming apparatus having the same structure as that shown in FIG. 1 except the intermediate transfer belt, and the intermediate transfer belt 5 produced in the above method is incorporated in the image forming apparatus.

Next, details of the experiment will be explained. In this experiment, 500 sheets of the same color image are continuously output using the following ten kinds of intermediate transfer belts produced by the above-described producing method, image quality of an intermediate sheet of the continuous output (100th sheet), and image quality of the last sheet at the time of completion of output (500th sheet) are checked, and it is checked whether the intermediate transfer belt 5 is cut or not. The image forming apparatus used in this output test can output at such an extremely high output speed in the field of the image forming apparatus as to output 50 color image sheets per one minute. In the output test, it is checked whether the intermediate transfer belt 5 meanders under such a high speed output as 50 sheets per minute by checking the image quality of the intermediate sheet of the continuous output (100th sheet), and it is checked whether the intermediate transfer belt 5 meanders when higher volume output is performed or endurance of the intermediate transfer belt 5 is checked by checking the image quality at the time of output completion (500th sheet) and by checking whether the intermediate transfer belt 5 is cut or not. In the following description, the average distance between the projections and depressions in the inner peripheral surface between the belt main body 50 is called an average distance "Sm," while the average distance between the projections and depressions of the guide portion 51 is called an average distance "Sm'"

FIRST EXAMPLE

The above output test is performed using an intermediate transfer belt consisting of a belt main body and a guide portion. In the belt main body, the ten-point average roughness (Rz) of the inner peripheral surface is 2.2 μm and the average distance (Sm) between the projections and depressions is 51 μm. In the guide portion, the average distance (Sm') between the projections and depressions of the adhesive surface is 5.8 times the average distance (Sm) between the projections and depressions of the inner peripheral surface of the belt main body.

SECOND EXAMPLE

The above output test is performed using an intermediate transfer belt consisting of a belt main body and a guide portion. In the belt main body, the ten-point average roughness (Rz) of the inner peripheral surface is 9.8 μm and the average distance (Sm) between the projections and depressions is 197 μm. In the guide portion, the average distance (Sm') of the projections and depressions of the adhesive surface is 2.1 times the average distance (Sm) between the projections and depressions of the inner peripheral surface of the belt main body.

THIRD EXAMPLE

The above output test is performed using an intermediate transfer belt consisting of a belt main body and a guide portion. In the belt main body, the ten-point average roughness (Rz) of the inner peripheral surface is 2.1 μm and the average distance (Sm) between the projections and depressions is 52 μm. In the guide portion, the average distance (Sm') between the projections and depressions of the adhesive surface is 2.1 times the average distance (Sm) between the projections and depressions of the inner peripheral surface of the belt main body.

FOURTH EXAMPLE

The above output test is performed using an intermediate transfer belt consisting of a belt main body and a guide portion. In the belt main body, the ten-point average roughness (Rz) of the inner peripheral surface is 9.9 μm and the average distance (Sm) between the projections and depressions is 196 μm. In the guide portion, the average distance (Sm') between the projections and depressions of the adhesive surface is 5.9 times the average distance (Sm) between the projections and depressions of the inner peripheral surface of the belt main body.

FIRST COMPARATIVE EXAMPLE

The above output test is performed using an intermediate transfer belt consisting of a belt main body and a guide portion. In the belt main body, the ten-point average roughness (Rz) of the inner peripheral surface is 1.8 μm and the average distance (Sm) between the projections and depressions is 53 μm. In the guide portion, the average distance (Sm') between the projections and depressions of the adhesive surface is 2.1 times the average distance (Sm) between the projections and depressions of the inner peripheral surface of the belt main body.

SECOND COMPARATIVE EXAMPLE

The above output test is performed using an intermediate transfer belt consisting of a belt main body and a guide portion. In the belt main body, the ten-point average roughness (Rz) of the inner peripheral surface is 11.0 μm and the average distance (Sm) between the projections and depressions is 198 μm. In the guide portion, the average distance (Sm') between the projections and depressions of the adhesive surface is 2.0 times the average distance (Sm) between the projections and depressions of the inner peripheral surface of the belt main body.

THIRD COMPARATIVE EXAMPLE

The above output test is performed using an intermediate transfer belt consisting of a belt main body and a guide portion. In the belt main body, the ten-point average roughness (Rz) of the inner peripheral surface is 2.5 μm and the average distance (Sm) between the projections and depressions is 45 μm. In the guide portion, the average distance (Sm') between the projections and depressions of the adhesive surface is 2.2 times the average distance (Sm) between the projections and depressions of the inner peripheral surface of the belt main body.

FOURTH COMPARATIVE EXAMPLE

The above output test is performed using an intermediate transfer belt consisting of a belt main body and a guide portion. In the belt main body, the ten-point average roughness (Rz) of the inner peripheral surface is 8.0 μm and the average distance (Sm) between the projections and depressions is 220 μm. In the guide portion, the average distance (Sm') between the projections and depressions of the adhesive surface is 5.6 times the average distance (Sm) between the projections and depressions of the inner peripheral surface of the belt main body.

FIFTH COMPARATIVE EXAMPLE

The above output test is performed using an intermediate transfer belt consisting of a belt main body and a guide portion. In the belt main body, the ten-point average roughness (Rz) of the inner peripheral surface is 3.0 μm and the average distance (Sm) between the projections and depressions is 81 μm. In the guide portion, the average distance (Sm') between the projections and depressions of the adhesive surface is 1.5 times of the average distance (Sm) between the projections and depressions of the inner peripheral surface of the belt main body.

SIXTH COMPARATIVE EXAMPLE

The above output test is performed using an intermediate transfer belt consisting of a belt main body and a guide portion. In the belt main body, the ten-point average roughness (Rz) of the inner peripheral surface is 9.0 μm and the average distance (Sm) between the projections and depressions is 197 μm. In the guide portion, the average distance (Sm') between the projections and depressions of the adhesive surface is 6.6 times the average distance (Sm) between the projections and depressions of the inner peripheral surface of the belt main body.

In the output tests of the first to fourth examples and first to sixth comparative examples, the image quality of the sheet (100th sheet) output in the course of the continuous output operation and of the sheet (500th sheet) output at the end of the continuous output operation are evaluated in the following three levels in accordance with the degree of disturbance in the image:

Excellent: no disturbance in image;

Fair: slight disturbance can be found in image but not serious; and

Failed: great disturbance exists in image.

In addition to the output test, in the intermediate transfer belts used in the first to fourth examples and first to sixth comparative examples, peel strength (thrust peel strength) of adhesive between the belt main body and the guide portion is measured. The measurement of the thrust peel strength will be explained.

Part of the intermediate transfer belts used in the first to fourth examples and first to sixth comparative examples to which the guide portions are adhered are cut out, and belt test pieces for measuring the thrust peel strength are prepared. The belt test piece each is a small rectangular piece having a length along the guide portion of 30 mm and a length perpendicular to the guide portion of 50 mm.

Figure 5:
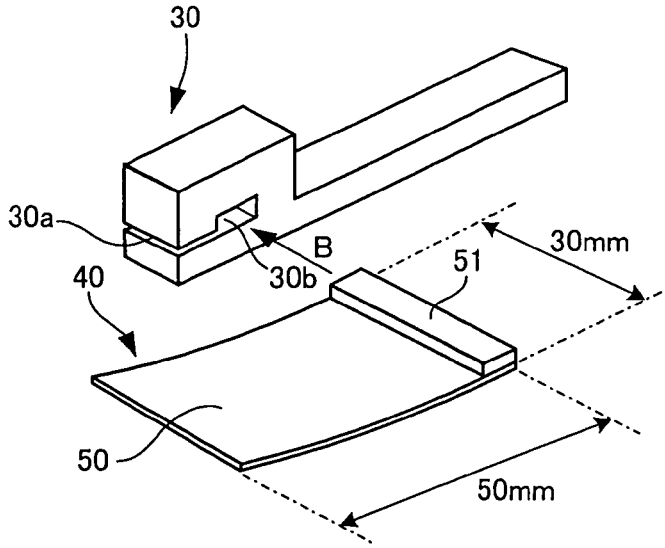
FIG. 5 is an explanatory view of a measuring test of a thrust peel strength.
Figure 5:
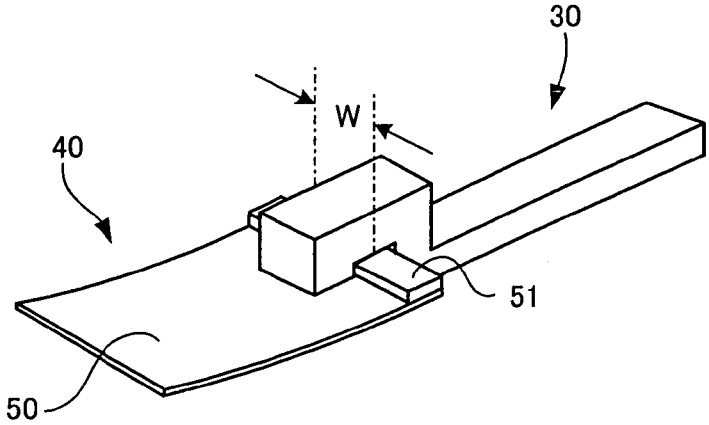
Figure 5:
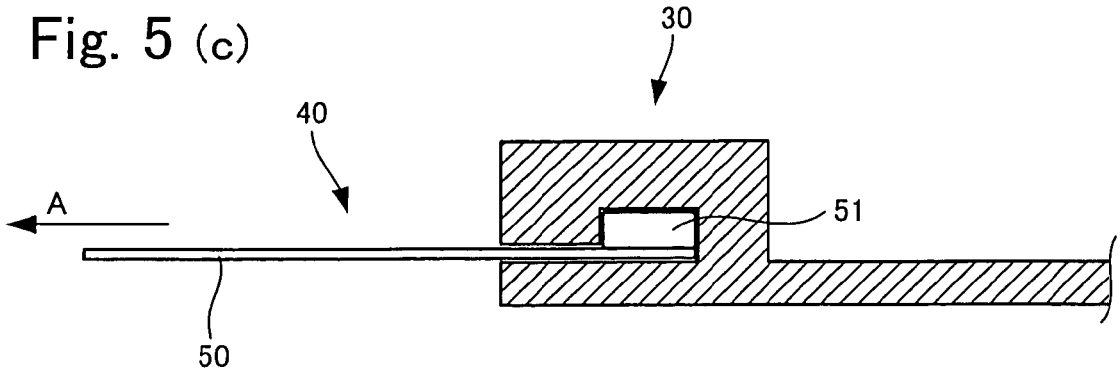

FIGS. 5 (*a*) through 5(*c*) illustrate an explanatory view of measuring test of the thrust peel strength.

FIG. 5 (*a*) shows a belt test piece 40 and a belt fixing member 30 that fixes the belt test piece 40. The belt fixing member 30 has a width of 10 mm. The belt fixing member 30 has, at its side surface, a guide portion through hole 30*b* through which a guide portion 51 passes, and a belt main body through hole 30*a* through which the belt main body 50 passes. When the measuring test of the thrust peel strength is performed, the guide portion 51 and the belt main body 50 of the belt test piece 40 are inserted into the through holes of the belt fixing member 30 as shown with arrow B of FIG. 5(*a*).

FIG. 5 (*b*) shows an outward appearance when the belt test piece 40 is fixed to the fixing member 30, and FIG. 5 (*c*) is a sectional view of the belt test piece shown in FIG. 5 (*b*).

In a state shown in FIG. 5 (*a*) and FIG. 5 (*c*), the belt test piece 40 is completely accommodated in the fixing member 30. In this state, the belt main body 50 is pulled in a direction shown with an arrow A shown in FIG. 5(*c*). At that time, a thrust force (shearing force) is applied to the adhering portion between the belt main body 50 and the guide portion 51. The pulling force is gradually increased in the direction of the arrow A and a force when the guide portion 51 is peeled off from the belt main body 50 is measured, the value (unit: N) is divided by a width W (10 mm) of the belt fixing member 30 to calculate the thrust peel strength (N/mm).

The thrust peel strength is measured at both high temperature (45° C.) and low temperature (5° C.), and a result is evaluated in the following three levels:

Excellent: thrust peel strength is 5.0 (N/mm) or higher both at high temperature (45° C.) and low temperature (5° C.);

Fair: thrust peel strength is less than 5.0 (N/mm) either at high temperature (45° C.) or low temperature (5° C.); and Failed: thrust peel strength is less than 5.0 (N/mm) both at high temperature (45° C.) and low temperature (5° C.).

The thrust peel strength of 5.0 (N/mm) or higher is necessary to suppress the meandering of the intermediate transfer belt. Thus, whether the thrust peel strength is 5.0 (N/mm) or higher is one of criteria to judge endurance of the intermediate transfer belt 5. The temperature in the image forming apparatus frequently increases up to about 45° C. and decreases down to about 5° C. Thus, the intermediate transfer belt 5 is required to exhibit sufficient endurance even at such high and low temperatures. It is possible to know the endurance of the intermediate transfer belt by evaluation of the thrust peel strength measuring result as mentioned above.

FIG. 6 is a Table showing a result of peel strength of the intermediate transfer belt 5 and output test of the first to fourth examples and the first to the sixth comparative examples. First, the third example and the first comparative example are compared with each other. A ratio (Sm'/Sm) of the average distance (Sm') between the projections and depressions of the adhesive surface of the guide portion and the average distance (Sm) between the projections and depressions of the inner peripheral surface of the belt main body is 2.1 in both the third example and the first comparative example, and the average distances (Sm) between the projections and depressions of the inner peripheral surface of the belt main body of both examples are similarly in the range of 52 μm to 53 μm. Thus, it is possible to estimate a preferable range of the ten-point average roughness (Rz) from the comparison between the third example and the first comparative example. In the first comparative example in which the ten-point average roughness (Rz) is 1.8 μm, the peel strength is "failed" and the guide portion is peeled off in the output test. In the third example in which the ten-point average roughness (Rz) is 2.1 μm, the peel strength is "excellent," the guide portion is slightly peeled off in the output test, but not so severe to stop the image forming operation, and the image quality of the sheet output at the end of the continuous output operation is almost excellent. From the comparison between the third example and the first comparative example, it can be estimated that if the ten-point average roughness (Rz) is about 2.0 μm or higher, the adhesive strength between the guide portion and the belt main body is high. Next, the second example and the second comparative example are compared with each other. In both the examples, the ratios (Sm'/Sm) of the average distance between the projections and depressions are the same and the average distances (Sm) between the projections and depressions of the inner peripheral surface of the belt main body are almost the same. In the second comparative example where the ten-point average roughness (Rz) is 11.0 μm, the peel strength is "fair" and the guide portion is peeled off in the output test. In the second example where the ten-point average roughness (Rz) is 9.8 μm, the peel strength is "excellent," the guide portion is not peeled off in the output test, and the image quality when the continuous output is completed is excellent. From the comparison between the second example and the second comparative example, it can be estimated that if the ten-point average roughness (Rz) is about 10.0 μm or lower, the adhesive strength between the guide portion and the belt main body is high.

From the comparison between the third example and the first comparative example, and from the comparison between the second example and the second comparative example, it can be estimated that if the ten-point average roughness (Rz) is in the range of 2.0 μm to 10.0 μm, the adhesive strength between the guide portion and the belt main body is high.

Next, the third example and the third comparative example are compared with each other. In the third example and the third comparative example, the ratios (Sm'/Sm) of the average distance between the projections and depressions are almost the same, and the ten-point average roughness (Rz) is respectively 2.1 μm and 2.5 μm and they are close to each other. From the comparison between the third example and the third comparative example, it is possible to estimate a preferable range of the average distance (Sm) between the projections and depressions of the inner peripheral surface of the belt main body. In third comparative example where the average distance (Sm) between the projections and depressions of the inner peripheral surface of the belt main body is 45 μm, the peel strength is "failed," and the guide portion is peeled off in the output test. In the third example where the average distance (Sm) between the projections and depressions of the inner peripheral surface of the belt main body is 52 μm, the peel strength is "excellent," the guide portion is slightly peeled off in the output test, but not so severe to stop the image forming operation, and the image quality when the continuous output is completed is almost excellent. From the comparison between the third example and the third comparative example, it can be estimated that if the average distance (Sm) between the projections and depressions of the inner peripheral surface of the belt main body is 50 μm or higher, the adhesive strength between the guide portion and the belt main body is high. Next, the fourth example and the fourth comparative example are compared with each other. Both the examples have almost the same ratios Sm'/Sm of the average distances between the projections and depressions, and the ten-point average roughness (Rz) of the inner peripheral surface of the belt main body that is in the range of 2.0 μm to 10.0 μm. In the fourth comparative example where the average distance (Sm) between the projections and depressions of the inner peripheral surface of the belt main body is 220 μm, the peel strength is "fair" and the image quality when the continuous output is completed is failed in the output test. In the fourth example where the average distance (Sm) between the projections and depressions of the inner peripheral surface of the belt main body is 196 μm, the peel strength is "excellent" and the image quality when the continuous output is completed in the output test is almost excellent. From the comparison between the fourth example and the fourth comparative example, it can be estimated if the average distance (Sm) between the projections and depressions of the inner peripheral surface of the belt main body is 200 μm or lower, the adhesive strength between the guide portion and the belt main body is high.

In all of the third example and the third comparative example, and the fourth example and comparative example, the ten-point average roughness (Rz) is in the range of 2.0 μm to 10.0 μm. From the comparison between the third example and comparative example as well as the comparison between the fourth example and comparative example, it can be estimated that if the ten-point average roughness (Rz) is in the range of 2.0 μm to 10.0 μm, and if the average distance (Sm) between the projections and depressions of the inner peripheral surface of the belt main body is in the range of 50 μm to 200 μm, the adhesive strength between the guide portion and the belt main body is high.

Next, the third example and the fifth comparative example are compared with each other. In the third example and the fifth comparative example, the ten-point average roughness (Rz) is 2.1 μm and 3.0 μm, respectively, and the average distances (Sm) between the projections and depressions of the inner peripheral surface of the belt main body are also 52 μm and 81 μm, respectively. Accordingly, in both the third example and fifth comparative example, the ten-point average roughness (Rz) and the average distance (Sm) between the projections and depressions of the inner peripheral surface of the belt main body are in the ranges where it is estimated that the adhesive strength is high. From the comparison between the third example and the fifth comparative example, a preferable range of the ratio (Sm'/Sm) of the average distance between the projections and depressions is estimated. In the fifth comparative example where the ratio (Sm'/Sm) of the average distance between the projections and depressions is 1.5, the peel strength is "fair" and the guide portion is peeled off in the output test. In the third example where the ratio (Sm'/Sm) of the average distance between the projections and depressions is 2.1, the peel strength is "excellent," the guide portion is slightly peeled off in the output test, but not so severe to stop the image formation, and the image quality when the continuous output is completed is almost excellent. From the comparison between the third example and the fifth comparative example, it can be estimated that if the ratio (Sm'/Sm) of the average distance is 2 or higher, the adhesive strength between the guide portion and the belt main body is high. Next, the fourth example and the sixth comparative example will be compared with each other. Both the examples have almost the same ten-point average roughness (Rz) and the average distances (Sm) between the projections and depressions of the inner peripheral surfaces of the belt main bodies. In the sixth comparative example where the ratio (Sm'/Sm) of the average distance is 6.6, the peel strength is "excellent" and the image quality of a sheet output in the course of the continuous output operation and of the sheet output at the end of the operation are both failed in the output test. It is conceived that since the average distance (Sm') of the projections and depressions of the adhesive surface of the guide portion is too long in the sixth comparative example, a wave of long wavelength appears in the guide portion surface, and disturbance is generated in an image in the high-speed image formation. In the fourth example where the ratio (Sm'/Sm) of the average distance is 5.9, the peel strength is "excellent" and the image quality of the sheet output in the course of the continuous output operation and of the sheet output at the end of the operation are both excellent. From the comparison between the fourth example and the sixth comparative example, it is estimated that if the ratio (Sm'/Sm) of the average distance is about six or lower, the adhesive strength between the guide portion and the belt main body is high.

In all of the third example, the fifth comparative example, the fourth example and the sixth comparative example, the ten-point average roughness (Rz) is in the range of 2.0 μm to 10.0 μm, and the average distance (Sm) between the projections and depressions of the inner peripheral surface of the belt main body is in the range of 50 μm to 200 μm. Moreover, the comparison between the third example and the fifth comparative example as well as the comparison between the fourth example and the sixth comparative example, it can be found that it is possible to realize an intermediate transfer belt having high adhesive strength between the guide portion and the belt main body and high endurance, if the ten-point average roughness (Rz) is in the range of 2.0 μm to 10.0 μm, and if the average distance (Sm) between the projections and depressions of the inner peripheral surface of the belt main body is in the range of 50 μm to 200 μm, and if the ratio (Sm'/Sm) is in the range of 2 to 6. If such an intermediate transfer belt is employed, an image can be formed without deteriorating the image quality even under high speed output or high volume output.

In the above explanation, polyimide-based resin, polyamideimide-based resin and polyester-based resin are used as a material of the belt main body, but it is also possible to employ polyurethane-based resin, polyamide-based resin and fluorine-based resin.

A material of the guide portion is not limited to polyurethane, and it is also possible to employ elastic body having appropriate hardness such as neoprene rubber, polyurethane rubber, silicone rubber, polyester elastomer, chloroprene rubber and nitrile rubber. The shape of the guide member is not limited to the substantially rectangular cross section as shown in FIG. 3, and other cross section shape may be employed. As adhesive used for adhering the guide member and the belt main body, it is possible to use pressure-sensitive adhesive, thermoplastic adhesive, rubber-based adhesive and the like, and adhesive that can elastically deform is preferable.

What is claimed is:

1. An endless belt comprising:

a belt main body in which a ten-point average roughness (Rz) of an inner peripheral surface thereof is in a range of approximately 2.0 μm or higher and 10.0 μm or lower and an average distance (Sm) between projections and depressions of the inner peripheral surface is in a range of approximately 50 μm or higher and 200 μm or lower; and a guide portion in which an average distance (Sm') between projections and depressions on an adhesive surface thereof adhered to the inner peripheral surface of the belt main body along an edge of the belt main body is approximately two times or higher and six times or lower the average distance (Sm) between projections and depressions in the inner peripheral surface.

2. The endless belt according to claim 1, wherein the belt main body includes at least one of polyimide-based resin, polyamideimide-based resin and polyester-based resin.

3. The endless belt according to claim 1, wherein the endless belt is an intermediate transfer belt.

4. The endless belt according to claim 1, wherein the endless belt is a transfer sending belt.

5. The endless belt according to claim 1, wherein thrust peel strength between the belt main body and the guide portion is approximately 5.0N/mm or higher.

6. The endless belt according to claim 1, wherein thrust peel strengths between the belt main body and the guide portion both at 45° C. and 5° C. are approximately 5.0N/mm or higher.

7. An image forming apparatus comprising:

an image holder;

a plurality of support members in a cylindrical shape that have recessed guide receivers formed in ends of the cylindrical shaped peripheral surface; and an intermediate transfer belt that is stretched by the support members and circulates and moves between the support members, receives transfer of a toner image from the image holder, and carries the transferred toner image to a position where the toner image is transferred onto a recording medium, the intermediate transfer belt comprising:

a belt main body in which a ten-point average roughness (Rz) of an inner peripheral surface thereof is in a range of approximately 2.0 μm or higher and 10.0 μm or lower and an average distance (Sm) between projections and depressions of the inner peripheral surface is in a range of approximately 50 μm or higher and 200 μm or lower, and a guide portion in which an average distance (Sm') between projections and depressions on an adhesive surface thereof adhered to an inner peripheral surface of the belt main body along an edge of the belt main body is approximately two times or higher and six times or lower the average distance (Sm) between projections and depressions in the inner peripheral surface, wherein the toner image is formed on a surface of the image holder, and an image consisting of a fixed toner image is formed on the recording medium by transferring and fusing the toner image onto the recording medium.

8. The image forming apparatus according to claim 7, wherein the belt main body includes polyimide-based resin, polyamideimide-based resin or polyester-based resin.

9. The image forming apparatus according to claim 7, wherein thrust peel strength between the belt main body and the guide portion is approximately 5.0N/mm or higher.

10. The image forming apparatus according to claim 7, wherein thrust peel strengths between the belt main body and the guide portion both at approximately 45° C. and 5° C. are approximately 5.0N/mm or higher.

11. An image forming apparatus comprising:

an image holder;

a plurality of support members in a cylindrical shape that have recessed guide receivers formed in ends of the cylindrical shaped peripheral surface; and a recording medium transfer belt that is stretched by the support members and circulates and moves between the support members while carrying the recording medium thereon, and receives transfer of a toner image on the recording medium from the image holder, the recording medium transfer belt comprising:

a belt main body in which a ten-point average roughness (Rz) between an inner peripheral surface is in a range of approximately 2.0 μm to 10.0 μm and an average distance (Sm) between projections and depressions of the inner peripheral surface is in a range of approximately 50 μm to 200 μm, and a guide portion in which an average distance (Sm') between projections and depressions on an adhesive surface thereof adhered to the inner peripheral surface of the belt main body along an edge of the belt main body is approximately two times or higher and six times or lower of the average distance (Sm) between projections and depressions in the inner peripheral surface, wherein the toner image is formed on a surface of the image holder, and an image consisting of a fixed toner image is formed on the recording medium by transferring and fusing the toner image onto the recording medium.

12. The image forming apparatus according to claim 11, wherein the belt main body includes polyimide-based resin, polyamideimide-based resin or polyester-based resin.

13. The image forming apparatus according to claim 11, wherein thrust peel strength between the belt main body and the guide portion is approximately 5.0N/mm or higher.

14. The image forming apparatus according to claim 11, wherein thrust peel strengths between the belt main body and the guide portion at approximately 45° C. and 5° C. are approximately 5.0N/mm or higher.

* * * * *